US012644345B2

(12) United States Patent
Schicker et al.

(10) Patent No.: US 12,644,345 B2
(45) Date of Patent: Jun. 2, 2026

(54) LOCATOR FOR SURVEY APPARATUS

(71) Applicant: Imdex Technologies Pty Ltd, Balcatta (AU)

(72) Inventors: Owen Schicker, Auckland (NZ); Christopher Pell, San Luis Obispo, CA (US)

(73) Assignee: IMDEX TECHNOLOGIES PTY LTD, Balcatta (AU)

( * ) Notice: Subject to any disclaimer, the term of this patent is extended or adjusted under 35 U.S.C. 154(b) by 0 days.

(21) Appl. No.: 18/852,722

(22) PCT Filed: Mar. 30, 2023

(86) PCT No.: PCT/IB2023/053163
§ 371 (c)(1),
(2) Date: Sep. 30, 2024

(87) PCT Pub. No.: WO2023/187693
PCT Pub. Date: Oct. 5, 2023

(65) Prior Publication Data

US 2025/0215754 A1 Jul. 3, 2025

(30) Foreign Application Priority Data

Mar. 31, 2022 (AU) ..... 2022900838

(51) Int. Cl.
*E21B 17/10* (2006.01)

(52) U.S. Cl.
CPC ..... *E21B 17/105* (2013.01); *E21B 17/1028* (2013.01)

(58) Field of Classification Search
CPC ..... E21B 17/105; E21B 17/1028
See application file for complete search history.

(56) References Cited

U.S. PATENT DOCUMENTS 5,358,040 A * 10/1994 Kinley ..... E21B 17/1021 175/325.3
9,249,633 B1 * 2/2016 Arizmendi ..... E21B 17/1035
(Continued)

FOREIGN PATENT DOCUMENTS

GB 2573295 A 11/2019

OTHER PUBLICATIONS

Australian Patent Office, Written Opinion issued in corresponding Application No. PCT/IB2023/053163 mailed Jul. 10, 2023.
(Continued)

*Primary Examiner* — Theodore N Yao
(74) *Attorney, Agent, or Firm* — Stites & Harbison, PLLC; Terry L. Wright

(57) ABSTRACT

A locator for positioning and/or stabilising a survey apparatus in a borehole comprising: two opposing members for cooperatively coupling together around a survey apparatus, the survey apparatus comprising at least one profiled region for a locator on the survey apparatus, each opposing member comprising: at least a first apparatus coupling, the first apparatus coupling configured to connect to a respective first apparatus coupling of the corresponding opposing member around the survey apparatus, one or more bearing members for bearing against a borehole, and wherein: the at least first apparatus coupling is configured to engage with the at least one profiled region on the survey apparatus to, when one opposing member is cooperatively coupled with the corresponding opposing member around the survey apparatus, constrain the resultant locator on the survey apparatus longitudinally and/or rotationally.

17 Claims, 13 Drawing Sheets

(56) References Cited

U.S. PATENT DOCUMENTS

| | | | | |
|---|---|---|---|---|
| 11,913,291 | B2 * | 2/2024 | McCormick | E21B 23/14 |
| 2020/0208404 | A1 * | 7/2020 | Agee | E04C 5/203 |

OTHER PUBLICATIONS

Australian Patent Office, International Search Report issued in corresponding Application No. PCT/IB2023/053163 mailed Jul. 10, 2023.
Australian Patent Office, Written Opinion issued in corresponding Application No. PCT/IB2023/053163 mailed Nov. 22, 2023.
Australian Patent Office, International Preliminary Report on Patentability issued in corresponding Application No. PCT/IB2023/053163 mailed Jul. 8, 2024.
Stafford Manufacturing Corp. Shaft Collars are offered with choice of bore design. Jun. 14, 2005.
Nediljka Gaurina-Medimurec. Casing Drilling Technology, Rudarsko-geolosko-naftni zbornik, vol. 17, Issue 1, pp. 19-26, published Dec. 4, 2005.

* cited by examiner

LOCATOR FOR SURVEY APPARATUS

FIELD OF THE INVENTION

The present invention relates to apparatus for positioning and stabilising survey apparatus within a borehole.

BACKGROUND TO THE INVENTION

Centralisers are used in surveying industries, typically in situations where a survey apparatus needs to be positioned radially and/or stabilised in place, whether this is in a uphole or downhole configuration.

Many of the centralisers that are currently available on the market have a variety of shortcomings.

SUMMARY OF INVENTION

It is an object of the present invention to provide a locator that positions and/or stabilises a survey apparatus in a borehole.

In one aspect the present invention may be said to comprise a locator for positioning and/or stabilising a survey apparatus in a borehole comprising:

two opposing members for cooperatively coupling together around a survey apparatus, the survey apparatus comprising at least one profiled region for a locator on the survey apparatus, each opposing member comprising: at least a first apparatus coupling, the first apparatus coupling configured to connect to a respective first apparatus coupling of the corresponding opposing member around the survey apparatus, one or more bearing members for bearing against a borehole, and wherein: the at least first apparatus coupling is configured to engage with the at least one profiled region on the survey apparatus to, when one opposing member is cooperatively coupled with the corresponding opposing member around the survey apparatus, constrain the resultant locator on the survey apparatus longitudinally and/or rotationally.

Optionally each opposing member comprises a second apparatus coupling, wherein the bearing members are bow springs that extend between the first and second apparatus couplings.

Optionally the second apparatus coupling of one opposing member is configured to: connect to a respective second apparatus coupling of the corresponding opposing member and to slide longitudinally on the survey apparatus when the one opposing member is cooperatively coupled with the corresponding opposing member around the survey apparatus.

Optionally the bearing member is a cantilevered spring.

Optionally:

each opposing member is integrally formed with the at least first apparatus coupling in the form of a half collar, and when the one opposing member is cooperatively coupled with the corresponding opposing member a collar is formed around the survey apparatus.

Optionally the one or more bearing members are flanges that extend radially from the opposing members.

Optionally the at least first coupling of the opposing member is configured with connectors to cooperatively couple to the corresponding member around the survey apparatus.

Optionally the connectors configure the first apparatus coupling to engage with the at least one profiled region.

Optionally the bearing members have bearing portions to bear against the borehole.

Optionally the bearing portions can be offset longitudinally.

Optionally the bearing members comprise wear pads where they bear against the borehole.

Optionally the survey apparatus comprises one or more sensor modules.

Optionally the profiled region on the survey apparatus is a tool engagement region.

Optionally the tool engagement region is on one or more locking couplings.

Optionally the first apparatus coupling is configured to engage with the at least one profiled region by way of a receiver key being complementary in shape with part of the profiled region.

Also described is a locator member for cooperatively coupling together with an opposing locator member around a survey apparatus, which comprises at least one profiled region, for a locator on the survey apparatus, the locator member comprising: at least a first apparatus coupling, the first apparatus coupling configured to connect to a respective first apparatus coupling of an opposing locator member, one or more bearing members for bearing against a borehole, and wherein: the at least first coupling is configured to engage with the at least one profiled region on the survey apparatus to, when the opposing locator member is cooperatively coupled with the opposing locator member around the survey apparatus, constrain the resultant locator on the survey apparatus longitudinally and/or rotationally.

Optionally the locator comprises a second apparatus coupling, wherein the bearing members are bow springs that extend between the first and second apparatus couplings.

Optionally the second apparatus coupling of one opposing member is configured to: connect to a respective second apparatus coupling of the corresponding opposing locator member and to slide longitudinally on the survey apparatus when the one opposing member is cooperatively coupled with the corresponding opposing member around the survey apparatus.

Optionally the bearing member is a cantilevered spring.

Optionally the bearing members have bearing portions to bear against the borehole.

Optionally the bearing portions can be offset longitudinally.

Optionally the bearing members comprise wear pads where they bear against the borehole.

Optionally the survey apparatus comprises one or more sensor modules.

Optionally the profiled region on the survey apparatus is a tool engagement region.

Optionally the tool engagement region is on one or more locking couplings.

Optionally the first apparatus coupling is configured to engage with the at least one profiled region by way of a receiver key being complementary in shape with part of the profiled region.

Also described is a locator for positioning and/or stabilising a survey apparatus in a borehole comprising: at least one member for cooperatively coupling together around a survey apparatus, the survey apparatus comprising at least one profiled region for a locator on the survey apparatus, each opposing member comprising: at least a first apparatus coupling, the first apparatus coupling configured to connect to a respective first apparatus coupling of the corresponding opposing member around the survey apparatus, one or more bearing members for bearing against a borehole, and wherein: the at least first apparatus coupling is configured to engage with the at least one profiled region on the survey apparatus to, when one opposing member is cooperatively coupled with the corresponding opposing member around the survey apparatus, constrain the resultant locator on the survey apparatus longitudinally and/or rotationally.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

The term "comprising" as used in this specification means "consisting at least in part of". Related terms such as "comprise" and "comprised" are to be interpreted in the same manner.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF DRAWINGS

Embodiments will be described with reference to the following drawings.

DETAILED DESCRIPTION

FIGS. 1 to 12 show embodiments relating to a locator (general embodiment 100) that is removably attachable to a survey apparatus 10 for positioning and/or stabilising the survey apparatus in a borehole. Typically the locator 100 can be used with survey apparatus 10, for example in the mineral exploration field or mining field, but this is not essential.

Overview

Figure 1:
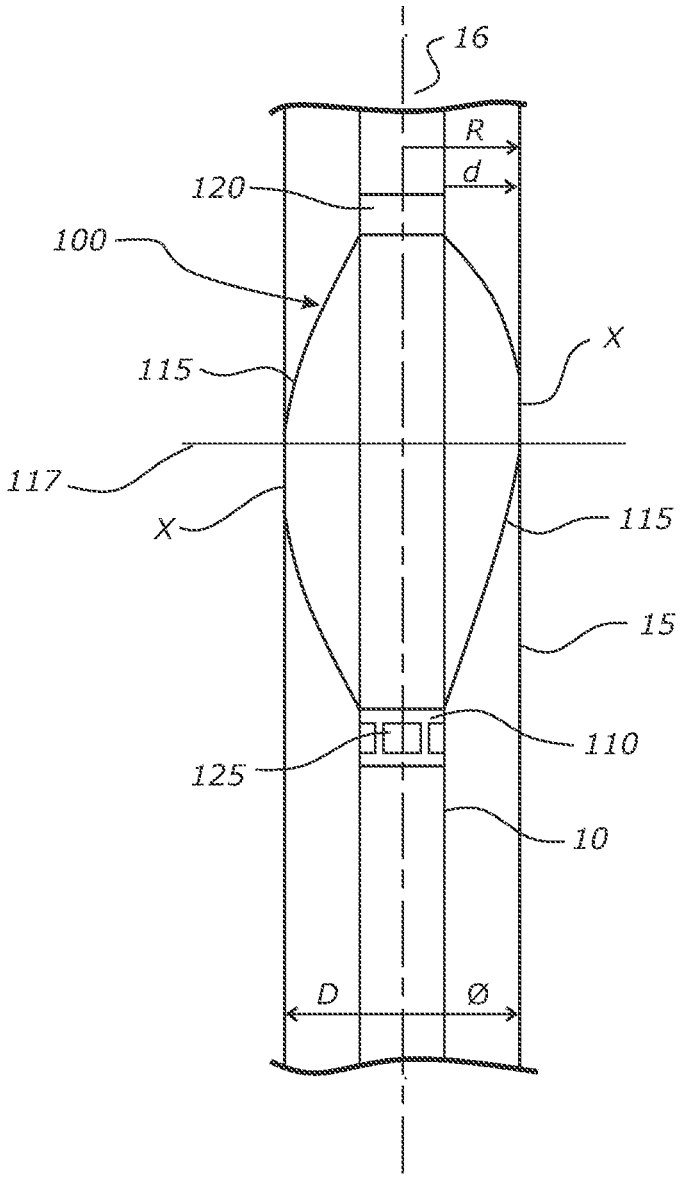
FIG. 1 shows in diagrammatic form a survey apparatus in a borehole with a locator attached.

A general overview is provided with respect to FIG. 1, which shows a locator 100 according to present embodiments in generic form and a typical survey apparatus 10 in diagrammatic form. This is non-limiting, but helps to explain illustrate the general features. The survey apparatus 10 is used for surveying the formation surrounding a bore hole whether for mineral exploration and/or mining purposes. The survey apparatus comprises one or more survey sensor modules (explained with reference to FIG. 2 later) that are coupled together when more than one sensor module is used.

Referring to FIG. 1, when the survey apparatus 10 is placed in a bore hole 15, it is desirable to have the survey apparatus located across the diameter D of the hole at a desired position to improve the accuracy of sensing. This desired position enables the survey apparatus 10 to be positioned with its central axis 16 central within the borehole (as shown—central axis and distance R), although in other instances this is not necessary. It is possible that the central axis 16 of the survey apparatus 10 is offset from centre. For example, if the tool is used with a gyro—then the survey apparatus being central is not so critical. But if used with a magnetic susceptibility tool—then the centralisation is more important. It is further desirable to stabilise the survey apparatus 10, so that movement is reduced leading to improvements in the accuracy of sensing as carried out by the survey apparatus. Such movements might include the reduction of longitudinal, radial and/or rotational movements.

According to present embodiments, this is achieved by a locator 100 that positions and/or stabilises the survey apparatus 10 in the borehole 15. A (non-limiting) diagrammatic version of a locator is shown in FIG. 1, and exemplary embodiments will be described later. The locator 100 is a removable attachment that couples to the survey apparatus 10. One or more locators 100 (two can be seen in FIG. 2) can be attached as required to the survey apparatus 10 to achieve the desired level of positioning and/or stabilization when the survey apparatus is placed in a bore hole, whether in a downhole or uphole orientation.

In general terms, the locator 100 comprises at least a first coupling 110 for removable attachment to a survey apparatus 10, and one or more bearing members 115 (which could take various forms, and not necessarily as shown in FIG. 1) for bearing against the borehole 15. The bearing members are moveable and provide for positioning and/or stabilisation of the survey apparatus 10 in the borehole 15. The locator 100 can have a second coupling 120, but that is not essential.

The survey apparatus 10 has one or more profiled regions e.g., 125, which at least the first coupling 110 of the locator 100 can engage with to assist with coupling the locator 100 to the survey apparatus 10. Engagement of the locator 100 with the profiled regions reduces the longitudinal and/or rotational movement of the locator 100 when coupled to the survey apparatus (also referred to as longitudinal and/or rotationally constrained). The profiled regions could be on one or more portions of the survey apparatus 10, such as on one or more modules of the survey apparatus. As an example, the profiled regions could be tool engagement regions. Such tool engagement regions are configured to receive tools used for assembly, disassembly and/or manipulation of modules of the survey apparatus. For example, a tool engagement region could be a spanner flat, for receiving a spanner for tightening and loosening sensor modules. Alternatively or additionally, the profiled regions could be fabricated for receiving the locator 100. A survey apparatus can have multiple tool engagement regions (see e.g. FIG. 2).

In use, the locator 100 is attached to the survey apparatus 10, and engages with the profiled region 125. Optionally, the attachment to the profiled region prevents rotational and/or longitudinal movement of the locator 100 relative to the survey apparatus. The survey apparatus 10 is placed in a borehole 15 and the moveable bearing members 115 bear and/or adapt to bear against the inside wall of the borehole 15 to position and/or stabilise the survey apparatus 10 in the borehole 15. Once the survey of the borehole is complete, the survey apparatus 10 is retrieved from the borehole 15, and the locator 100 can be readily replaced, removed for re-use or simply retained on the survey apparatus for the surveying of the next borehole.

The locator may options have further couplings, which might not be rotationally and/or longitudinally constrained with the survey apparatus.

Exemplary Survey Apparatus

Embodiments of the locator 100 will be described. However first an exemplary embodiment of a survey apparatus will be described with reference to FIG. 2. The locator 100 embodiments described herein can be used with the exemplary survey apparatus shown. It will be appreciated however that this is only one example of a survey apparatus 10 for context, and that the locator 100 embodiments described herein could be used with other types of survey apparatus. For example, the locator could be used with one of the applicant's tools, such as the tool described in PCT/AU2020/051305 which is incorporated herein by reference in its entirety.

Figure 2:
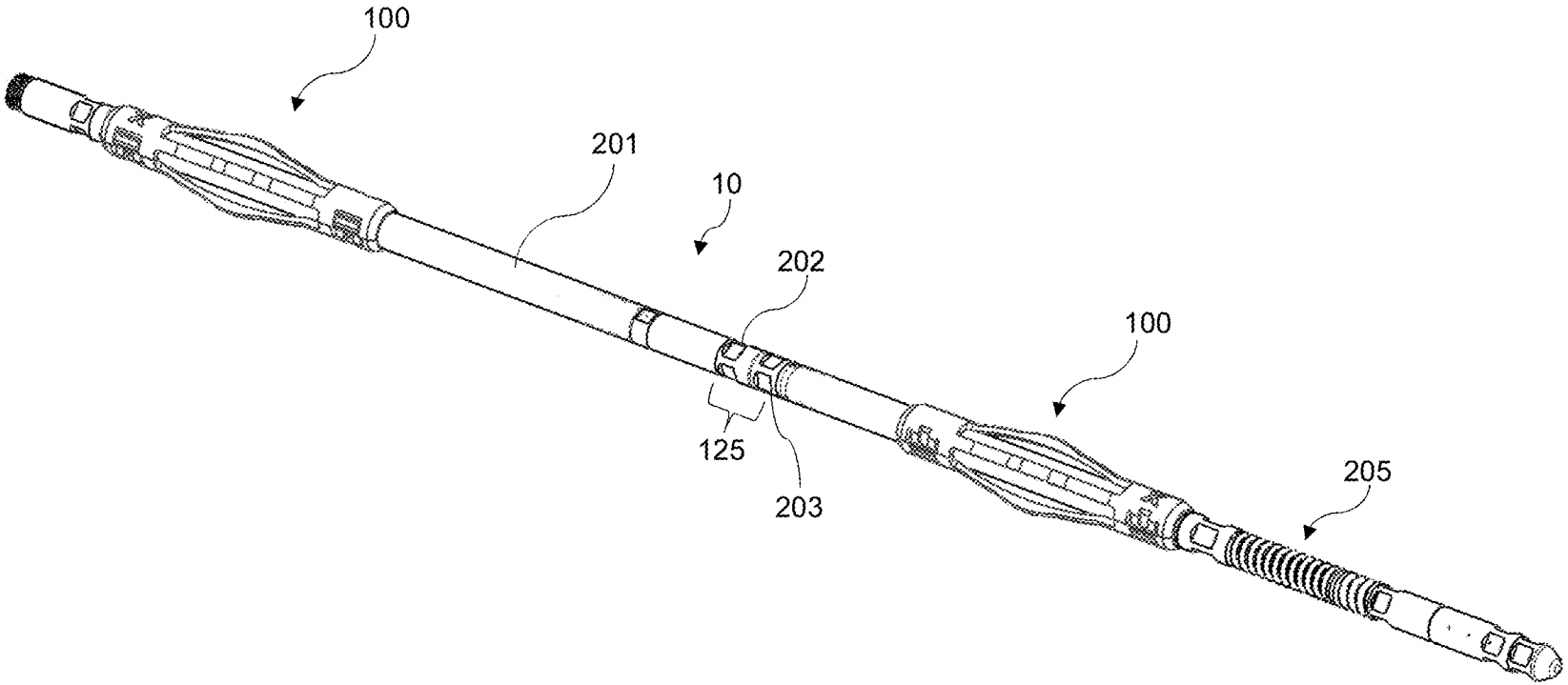
FIG. 2 shows a typical survey apparatus with two locators according to the first embodiment.

Referring to FIG. 2, the survey apparatus comprises one or more sensor modules. A survey apparatus housing 201 (also termed "pressure barrel") is provided, and one or more sensor modules can be provided within the housing. The sensors modules might be one or more of (without limitation), for example a magnetic susceptibility sensor, a gamma radiation sensor, an accelerometer, a gyroscope or any other geological sensor that assists with surveying of the hole and/or formation. The assembled sensor modules are then secured in place inside the housing by locking couplings 202, 203. The locking couplings have tool engagement regions (that is profiled regions) 125 in the form of spanner flats, so that spanners can be used to tighten and loosen the locking couplings 202, 203 for assembly and disassembly of the sensor modules. The spanner flats comprise four flats, sides/top/bottom—although fewer or more could be provided. There might be multiple housing/sensor module assemblies coupled together to form the survey apparatus. There can be multiple locking couplings/tool engagement regions on the survey apparatus.

A shock absorbing module such as a bump sub 205 can be provided to the end of the survey apparatus that on deployment will contact the top or bottom of the borehole.

The survey apparatus might have other typical features, not shown, that would be known to those skilled in the art. For example, the survey apparatus might be wireline deployable and retrievable, and therefore will have components to assist with this deployment.

Locators according to present embodiments can be provided on the survey apparatus. Two of the locators according to the first embodiment is shown in FIG. 2, this is by way of example only. Other locators could be provided on such a survey apparatus. Each locator is coupled to a tool engagement region.

First Locator Embodiment

A first embodiment of a locator 300 is described with reference to FIGS. 3A to 3E and 4. In this case, the locator 300 is used with a survey apparatus 10 as described with reference to FIG. 2.

The locator 300 comprises two (opposing) locator members 301 that are configured to cooperatively couple (e.g. clip) together around the survey apparatus 10. (The locator members are identical, so the same reference numerals are used). Each locator member 301 is one half of the locator 300. Together the pair of locator members are opposing members 301 that assemble/couple around the survey apparatus 10 to form the resultant, generally longitudinal, locator 300 on the survey apparatus. The locator has a longitudinal channel for receiving a survey apparatus. Each opposing member 301 clips together around the survey apparatus 10 so that the survey apparatus sits in the resulting longitudinal channel. The opposing members 301 are also configured to decouple (e.g. unclip) to disassemble/decouple the locator 300 from the survey apparatus 10.

To achieve this, each opposing member 301 comprises a first apparatus coupling 302 and a second apparatus coupling 303, preferably at each end of the opposing member 301. The first and second apparatus couplings are formed as first and second collars. A plurality of bearing members 304 (two shown, but any suitable number is possible) extend between the first and second apparatus couplings/collars 302, 303. The bearing members 304 are moveable (in a radial direction R with respect to when the locator is installed on the survey apparatus) under force. The bearing members are for expanding radial in and out for bearing against a borehole wall to position a survey apparatus radially within the borehole. Preferably the bearing members 304 are compliant. The compliance of the member is designed by means of geometry and material selection to allow for a required level of force to be applied to the wall of the borehole at the contact patch (315). The first and second apparatus couplings 302, 303 of an opposing member 301 can couple (around the survey apparatus 10) to corresponding first and second apparatus couplings 302, 303 of the corresponding opposing member 301 to form the, generally longitudinal, locator (See e.g. FIG. 3B, 3E). When coupled, the opposing members are configured to engage with at least one of the spanner flats 202, 203 (tool engagement regions 125) (See FIG. 2, 4).

Figure 3A:
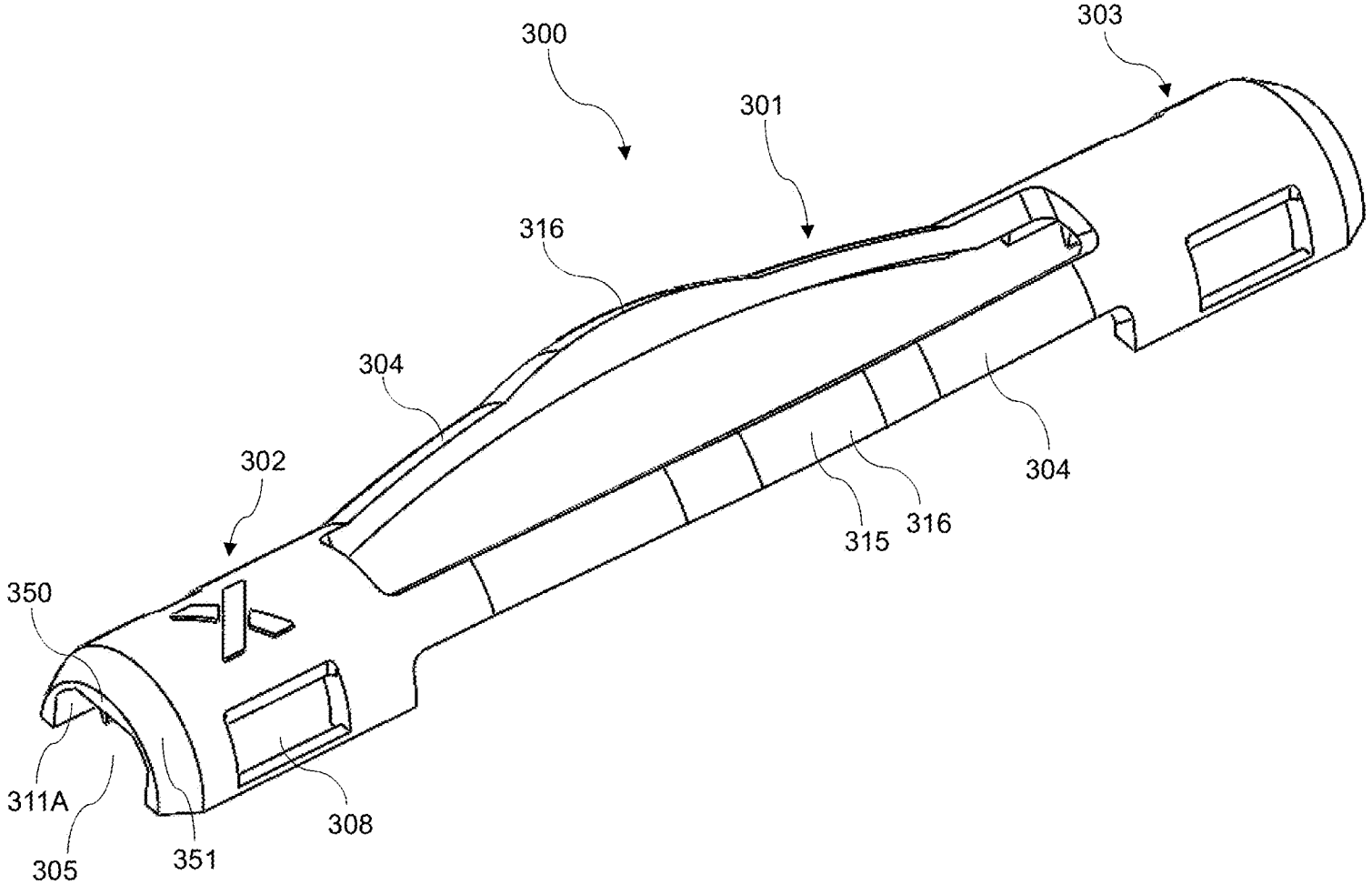
FIG. 3A to 3E show various views of the locator according to the first embodiment.
Figure 3B:
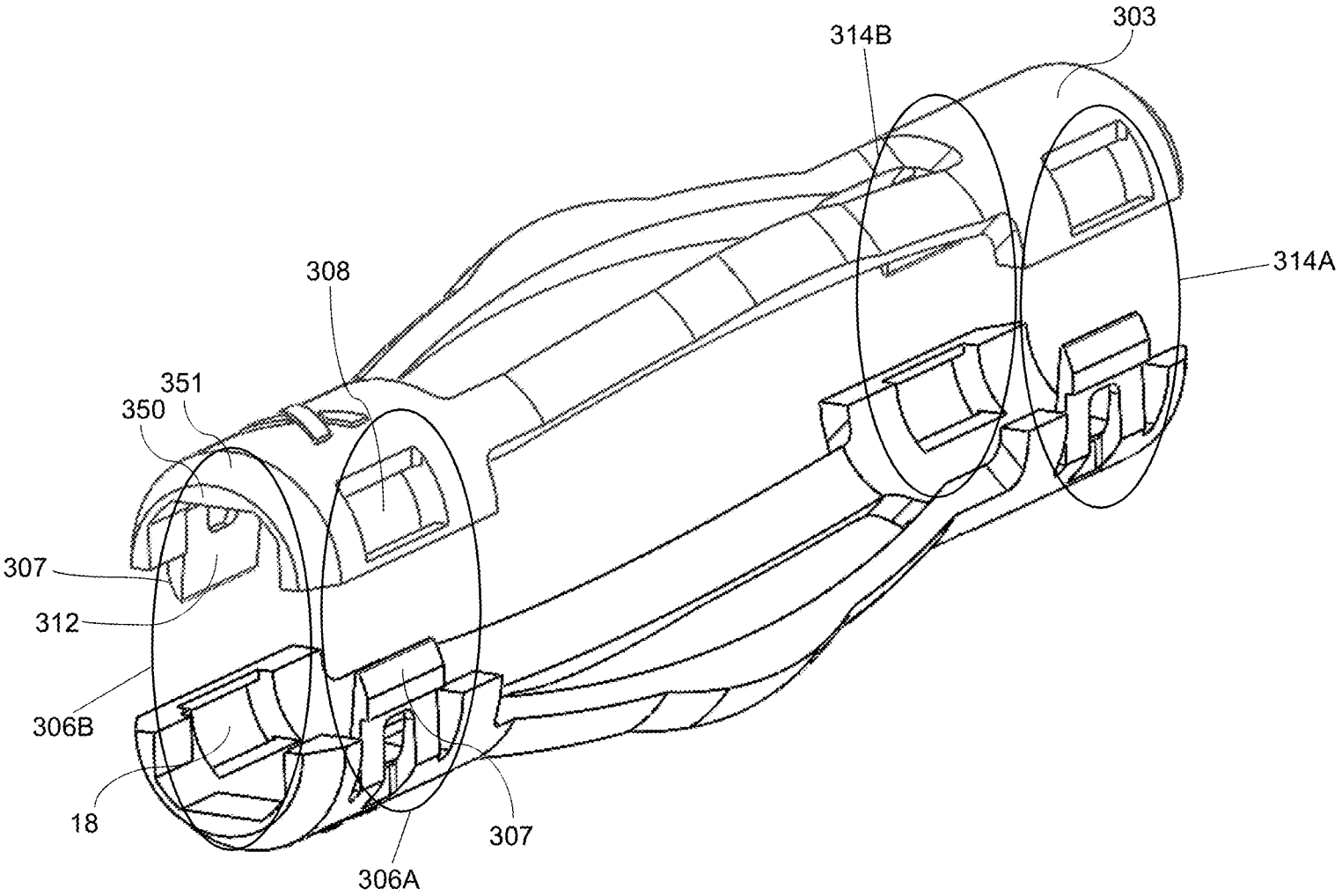

The first apparatus coupling 302 takes a generally semi-cylindrical form which defines a space 305, such that when first apparatus coupling 302 couples to the corresponding first coupling 302 on the opposing member 301, the two first apparatus couplings 302 cooperate to form a generally cylindrical assembly with a central opening (see FIG. 3B). The first apparatus coupling 302 of an opposing member 301 has retention coupling 306A, 306B (see FIG. 3B) connecting to a corresponding retention coupling 306A, 306B of the first apparatus coupling of the other opposing member. The retention coupling 306A, 306B takes the form of a snap fit cantilever male connector 307 and reciprocal female socket connector 308. The male connector 307 of the first opposing member engages with a reciprocal female socket 308 connector on the other opposing member 301, and the female socket 308 on the first opposing member receives the reciprocal snap fit cantilever male connector 307 of the other opposing member. The snap fit cantilever tab 307 on each opposing member 301 has a tapered barb 309 for engagement in and retention by a abutment 310 on the female socket on the opposing member (See FIG. 3D).

Figure 3C:
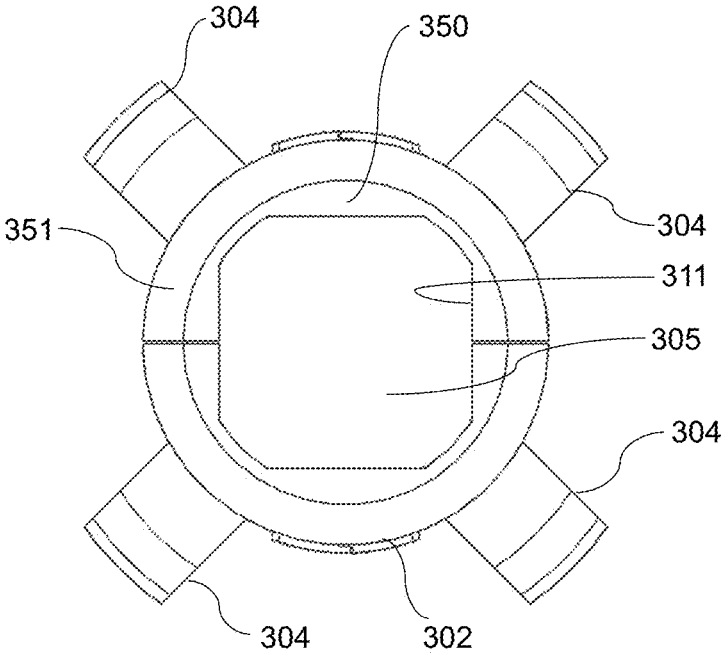
Figure 3D:
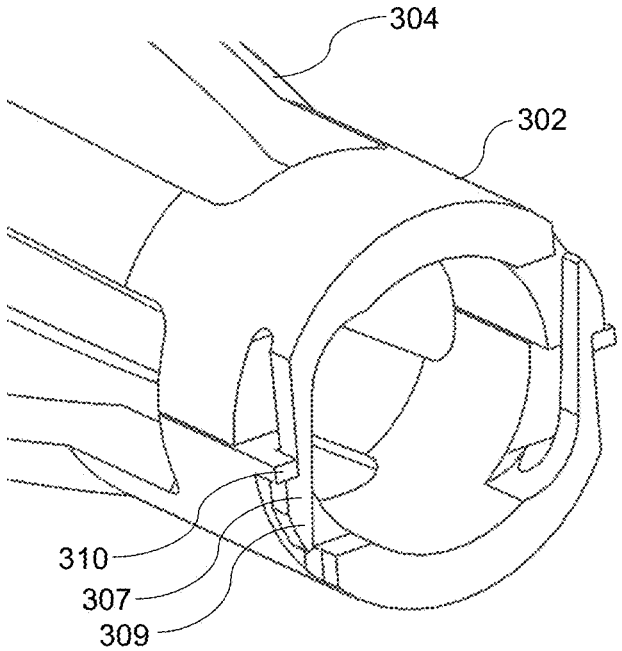

FIG. 3D (which shows a section through the first apparatus coupling in a plane through the connectors 307, 308 and omits the internal profile to be described later) shows the two opposing members coupled together using the connectors, where it can be seen that the male cantilevered tabs 307 for each coupling are engaged in the female socket 308. This occurs easily in a snap fit movement that can be achieved by hand without tools. To uncouple the two opposing members, the user can press on the bevelled portion of the barb 309 and unclip the barb from the aperture 308.

It will be appreciated that this is just one type of retention coupling. Other types are possible. For example, there might be just a single male or female connector on each opposing member 301 rather than both a male and female connector. Alternatively, a different type of snap fit, or even a different type of connector altogether could be used.

Referring to FIGS. 3A, 3B, the first apparatus couplings on each opposing member are configured to cooperatively couple to the survey apparatus 10 in a manner that constrains rotational and/or longitudinal movement of the couplings and therefore locator with respect to the survey tool. Together they form a first coupling assembly. The inside end of the first apparatus coupling 302 is configured to key (engage) with part of a tool engagement region (profiled region) 125 on the survey apparatus 10. The first apparatus coupling 302 is configured with an internal profile that has sidewalls and a top wall, the internal profile forming a receiver key 311A being complementary in shape with part of the tool engagement portion 203 of the survey apparatus 10. This can be seen better in FIG. 4. When the first apparatus coupling 302 is disposed on the survey apparatus 10, the receiver key 311A seats/engages with the commensurate shaped top/side part of the shape of the tool engagement region 203. The remainder of the inside of the first apparatus coupling 302 can be any suitable shape such as semi-cylindrical to abut against the cylindrical shape of the housing 201 of the survey apparatus 10. Referring to FIG. 3C, when the first apparatus coupling 302 joins with the complementary first apparatus coupling 302 of the other opposing member 301, the receiver key 311A of both first apparatus couplings 302 jointly form a generally oblong receiver key 311 that matches and seats/engages with the tool engagement region 125. Likewise the semi-cylindrical portions (see FIG. 3D) jointly form to create a cylindrical passage for receiving the survey apparatus 10. It will be noted that the coupling 302 has a flat face 350, albeit optionally with a chamfer 351 on the circumference. In an alternative, the chamfer could be much longer, and in one option the end could be completely or almost completely tapered, such that the face 350 is very small or non-existent. This enables the locator to move down hole with the taper pushing through any intrusions.

The cantilever tab 307 has a flat back surface 312 that is exposed to the inner gap of the first apparatus couplings 302 of both opposing members 301. Optionally, this tab 307/312 is configured to key with part of a second tool engagement region 202 on the survey apparatus. This also forms a receiver key having a complementary shape with part of the second tool engagement portion of the survey apparatus. This can be seen better in FIG. 4. This can be an additional receiver key to the receiver key formed by the inside end profile of the first coupling, being a receiver key that can engage with a second tool engagement region. When the first apparatus coupling 302 is disposed on the survey apparatus 10, the back 312 of the tab 307 seats/engages with the commensurate one side part of the tool engagement region 125 having the same shape. This flat tab 312 can engage with the second tool engagement portion 125 to assist with longitudinal and/or rotational constraint in addition to the profiled region 125. When the first apparatus coupling 302 of one opposing member 301 joins with a complementary first apparatus coupling 302 of the other opposing member 301, the tab 312 receiver key of both first apparatus couplings 302 jointly form a side receiver key that seats/engages with the tool engagement region 125.

The second apparatus coupling 303 is similar in nature to the first apparatus coupling 302, except that it does not have a receiver key shape 311 and is not configured for engagement with a tool engagement portion 125. Rather, the inside of the second apparatus coupling 303 is semi-cylindrical, and when joined to the complementary second apparatus coupling 303 of the other opposing member 301, the two can slide freely longitudinally and are not constrained rotationally. It could be described as "floating" (with respect to the survey tool when installed). The second apparatus coupling 303 has a retention coupling 314A, 314B (the male and female connectors) as described for the first apparatus coupling 302, and which couple to the complementary retention coupling of the corresponding second apparatus coupling 303 of the other opposing member 301. It will be noted that the coupling 303 has a flat face 352, albeit optionally with a chamfer 353 on the circumference. In an alternative, the chamfer could be much longer, and in one option the end could be completely or almost completely tapered, such that the face 350 is very small or non-existent. This enables the locator to move uphole with the taper pushing through any intrusions.

Each bearing member 304 on an opposing member 301 takes the form of an elongated bowed strip that is compliant. For example, the bearing member may be formed from a material that provides spring when bowed, thus providing a biased convex member that can bear against the borehole. The strip is flexible, so that it is compliant and bends inwards when receiving external force from the borehole wall when squeezed into the borehole. It is also resilient/biased so that it can return to the resting biased state when the locator is removed from the borehole 15. Each bearing member 304 may be a separate part that is joined to the first and second apparatus couplings 302, 303 during manufacture, or alternatively integrally formed with the first second couplings, for example through a moulding process. Because, a) one end of the bowed strip is secured (rotationally and/or longitudinally) against the survey tool via the first coupling, and b) one end of the bowed strip is "floating" (that is, not rotationally and/or longitudinally constrained against the survey tool due to the second coupling; this allows the bowed strip bearing member to bow radially in and out against the bore hole wall during movement of the survey tool down hole as the wall diameter changes. As the bow strip bows radially outwards towards to the borehole wall, the second coupling will move longitudinally towards the first fixed coupling to provide more radial expansion, and as the bow strip bows radially inwards the second coupling will move longitudinally away from the first fixed coupling to allow for radial contraction.

The bearing member 304 has a bearing portion 315 at the apex of the bow that contacts the borehole wall 15 (see "x" FIG. 1) when the locator 300 and survey apparatus 10 assembly is placed in a borehole. The apex could be in the longitudinal centre 117 (see FIG. 1) of the bearing member, or alternatively any other longitudinal position on the member (which is what occurs in this embodiment). Further, the apex of each bearing member does not have to be in the same position as the apex of other bearing members (again, see FIG. 1). For example, the apex 315 of each bearing member 304 might be in a different longitudinal position. In fact there may be a benefit to offset the apex 315 of each bearing member from the apex of each other bearing member, to reduce the risk of the survey apparatus 10 and/or the locator 300 becoming stuck in the borehole. The different longitudinal contact points "x" of the bearing portions 315 assist with this. The different contact points along the length of the locator 300 mean that circumferential features of the borehole 15 do not engage all of the members 304 at one time (that is, they do not all compress at the same time), reducing the risk of large shocks being received by the tool and reducing the chance of the device becoming or getting stuck in hole.

The bearing portion 315 can optionally have a wear pad 316, to provide wear resistance. This could be metal or ceramic, for example. There could be an indicator, such as ribbing, to indicate when wear has reached a point that the member needs replacing.

Length of the bearing members 304 can be any suitable length, based on various factors such as achieving the required compliance.

The length of each opposing member 300, by way of configuring the length of the first and second apparatus couplings 302, 303 and the bearing members 304, will be configured to provide a suitable length of locator to achieve the desired coupling and positioning/stabilisation.

Each opposing member 301 will be dimensioned (including each bearing member and the apex, will be provided in a longitudinal, rotational (around the apparatus) and radial position) to provide the required positioning of the survey apparatus 10 when in the borehole 15. Referring to FIG. 1, in the case where the apparatus is to be centralised 16, the apex 315 of each bearing member may be at identical radial distances d from the longitudinal centre. However, in cases where the survey apparatus 15 may need to be offset radially in the borehole, the apex 315 of different members may have different radial displacements d relative to a central axis 16, to provide the required offset. The radial displacement d of each apex 315 will be at least the radius R of the hole (or at least the radius of the portion of the borehole where the locator needs to reside when providing its function) so that the biased apex can provide a reaction force against the borehole wall to hold the survey apparatus in place. The radial displacement of the apex may differ depending on various requirements, such as the level of compliance, nature of the fabricating material, level of stability required, the survey module used etc. The bearing members are able to compress by a designed amount depending on the application and hole.

Each opposing member 300 can be fabricated from any suitable material, such as plastics, metal or similar. It is possible that the first and apparatus second 302, 303 couplings may be fabricated from a different material to the bearing members 304, or the same material. The bearing members will be fabricated from a suitably compliant/resilient/spring. The parts of each opposing members could be moulded, machined or otherwise fabricated as a single integral component, or they could be assembled.

In summary, the compliance is based on length and profile of member 304. It is also a result of the material used to construct the apparatus. It is end-use dependent. Short and stiff members are more suited to consistent diameter holes like inside a drill rod. Longer more flexible members are better suited for less consistent holes like open holes without a casing. These different design decisions combine to provide an appropriate amount of holding force to the borehole wall. Some materials are better suited to continuous flexure, e.g. plastics. A main design criteria is that the resultant sized locator is appropriately sized for the borehole. It is anticipated that the tooling for this invention will have the same collars but the moulding for the bearing member can be swapped in as required. It could be designed for standard holes such as N1, H1, H2. This is because the drill rigs all have standard sizes.

Figure 5:
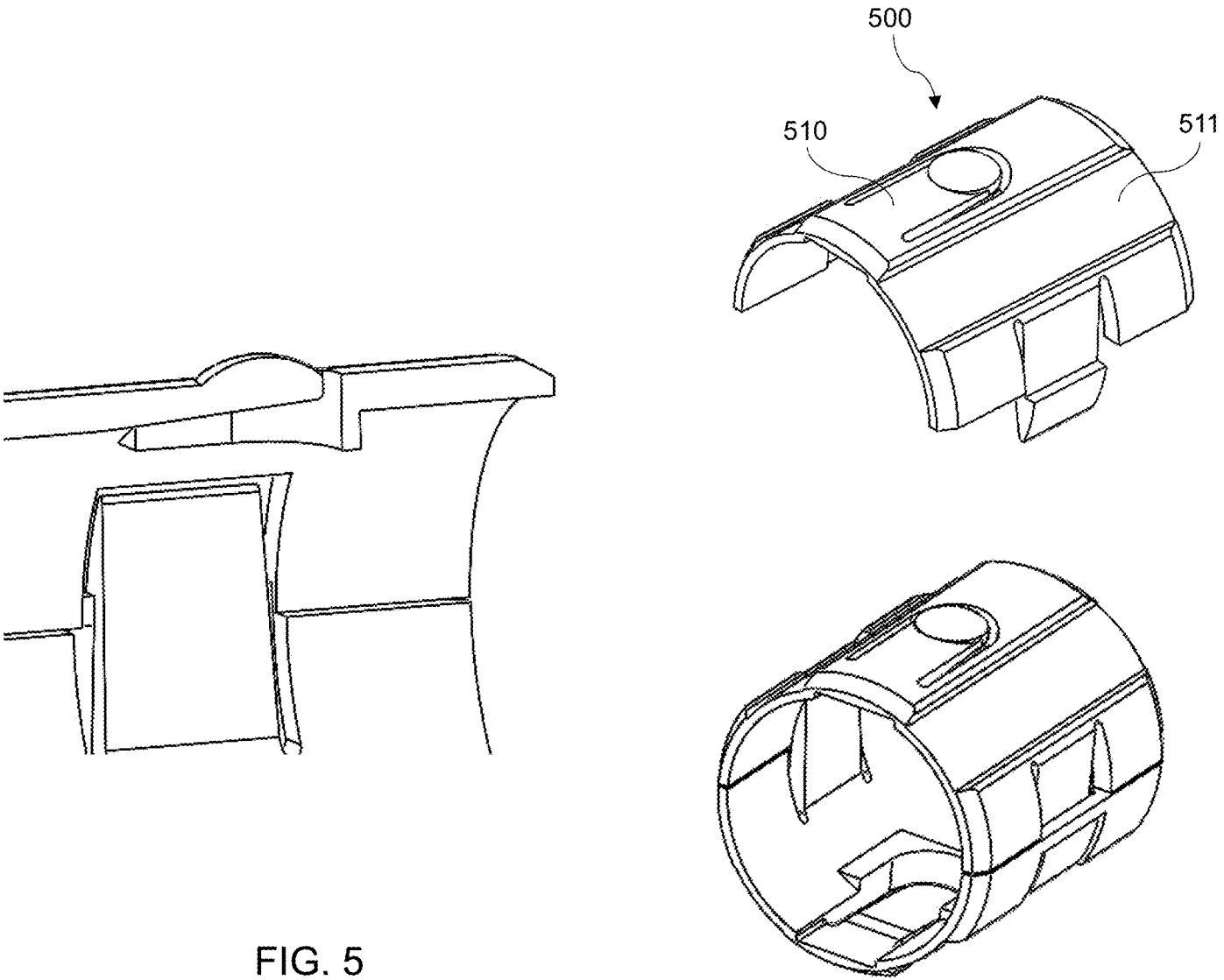
FIG. 5 shows a locator according to a second embodiment.
Figure 6:
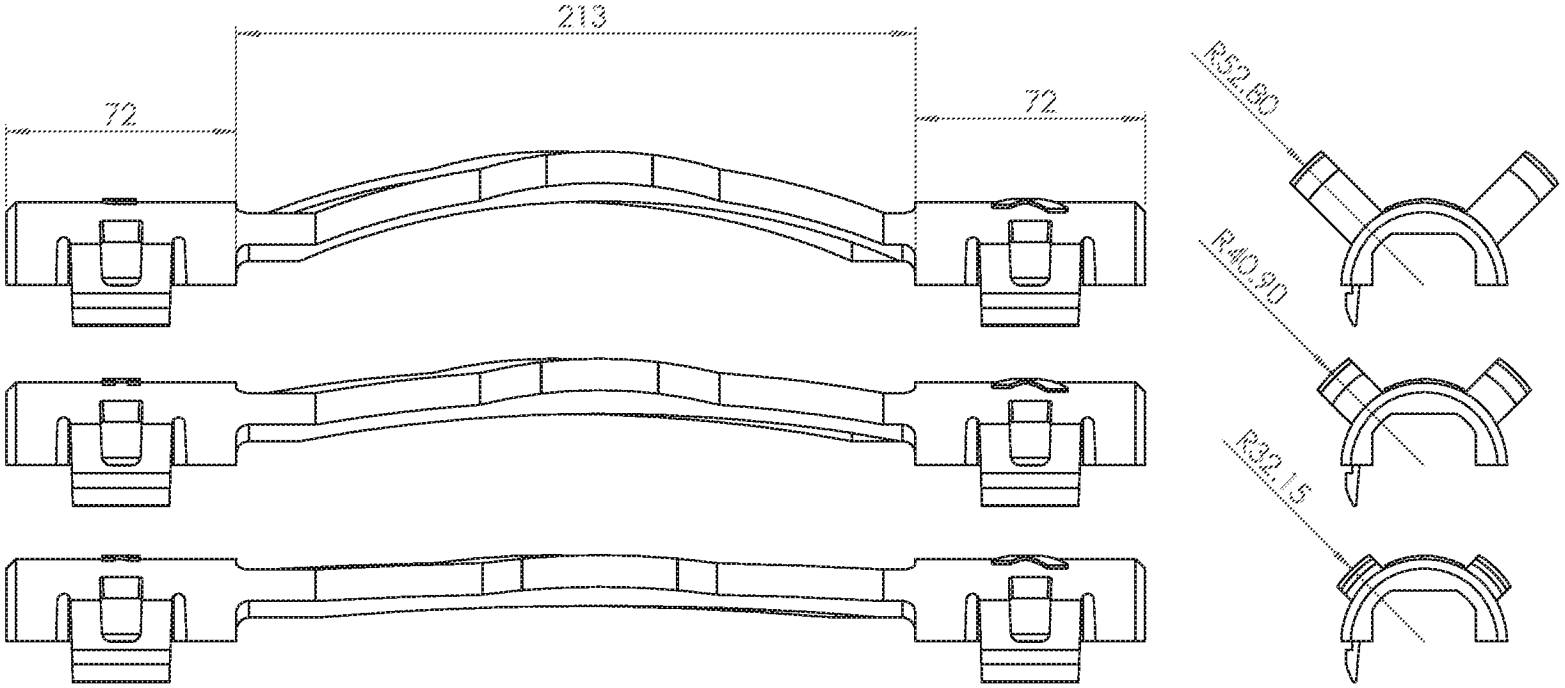
FIG. 6 shows non-limiting exemplary dimensions of possible examples of the first locator embodiment.
Figure 7:
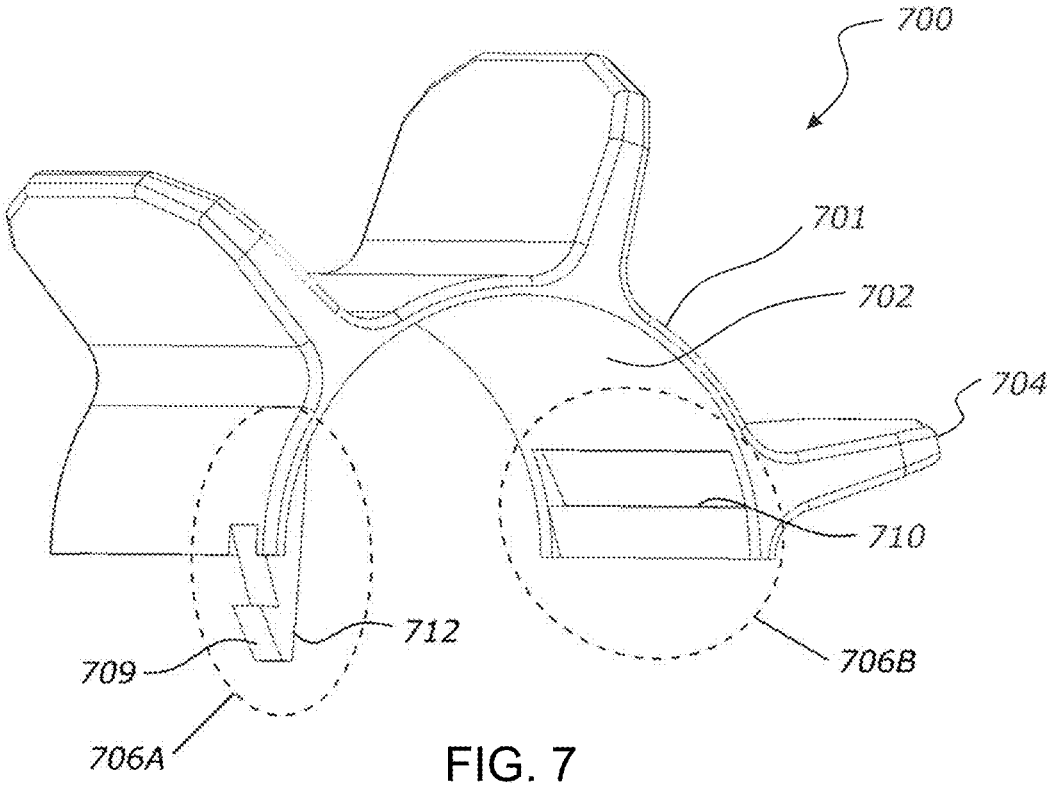
FIGS. 7 to 10 show various views of the locator according to the third embodiment.

As an example, the bow lengths (bearing member 304) have a length and angle from the collar, so that the bow of each bearing member is modified to obtain the different R distances, compression and/or compliance/resilience depending on the diameter/radius of the hole the locator is used in. For example, and without limitation, each bearing member could be designed so R is between about 30 cm and about 40 cm, or between about 40 cm and 50 cm, or between about 50 cm and 60 cm. Some non-limiting examples of design are 52.8 cm, 40.9 cm and 32.15 cm as shown in FIG. 5, which are designed from smallest to largest for N, H and P holes. All of the H size holes are relatively the same. The respective hole diameters for these are 60.3 mm, 77.80 mm and 101.6. The bearing members (that is, their bow) are designed to compress (in this case and as a non-limiting example only) 2 mm from the relaxed position in the hole. While this may seem a small amount of movement, the material from which the locator is constructed from can be very stiff and because there are a plurality of bearing members (e.g. 4 in this case) all compressing at that same time, there is sufficient force being provided. This provides a snug fit where there is a balance between radial force against the borehole wall to hold it in place (which friction from the wear pads assists), ability to move at the same time and also the ability to accommodate the variation in bore hole diameter.

Figure 3E:
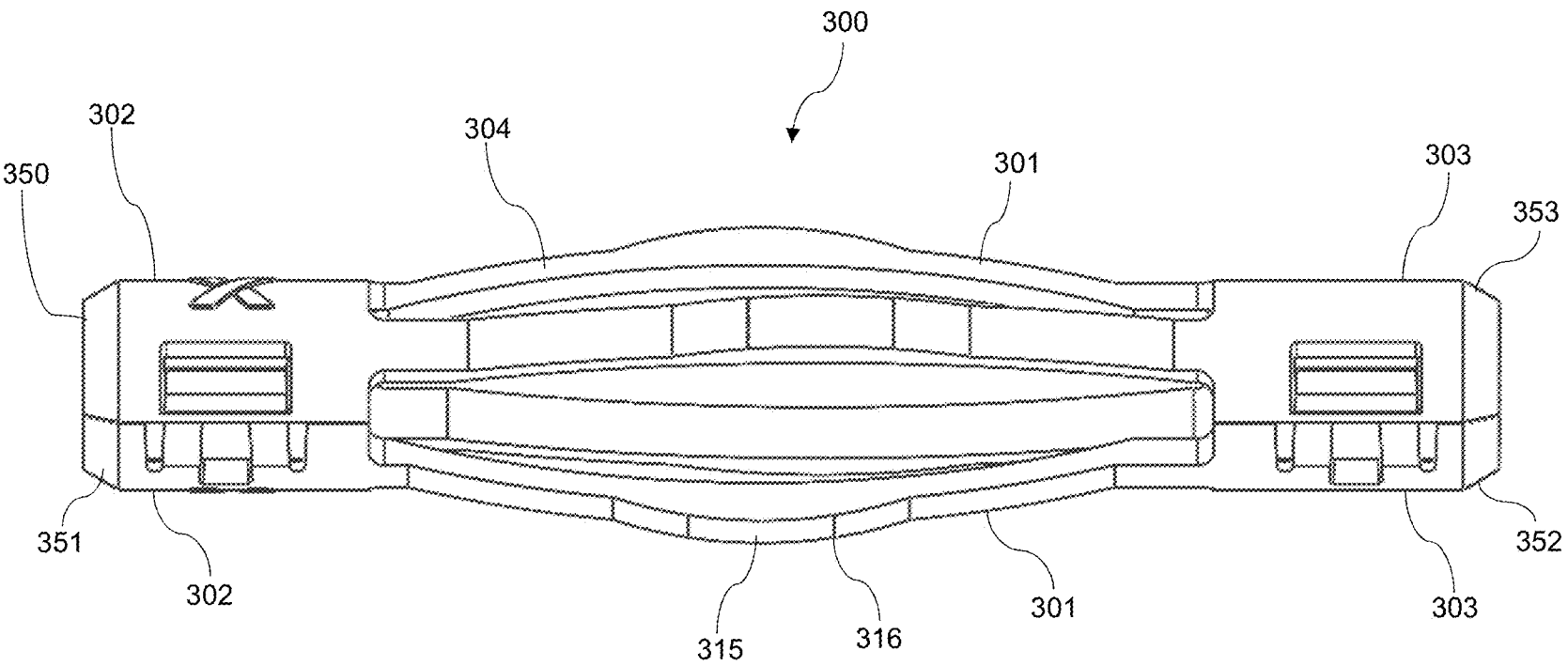
Figure 4:
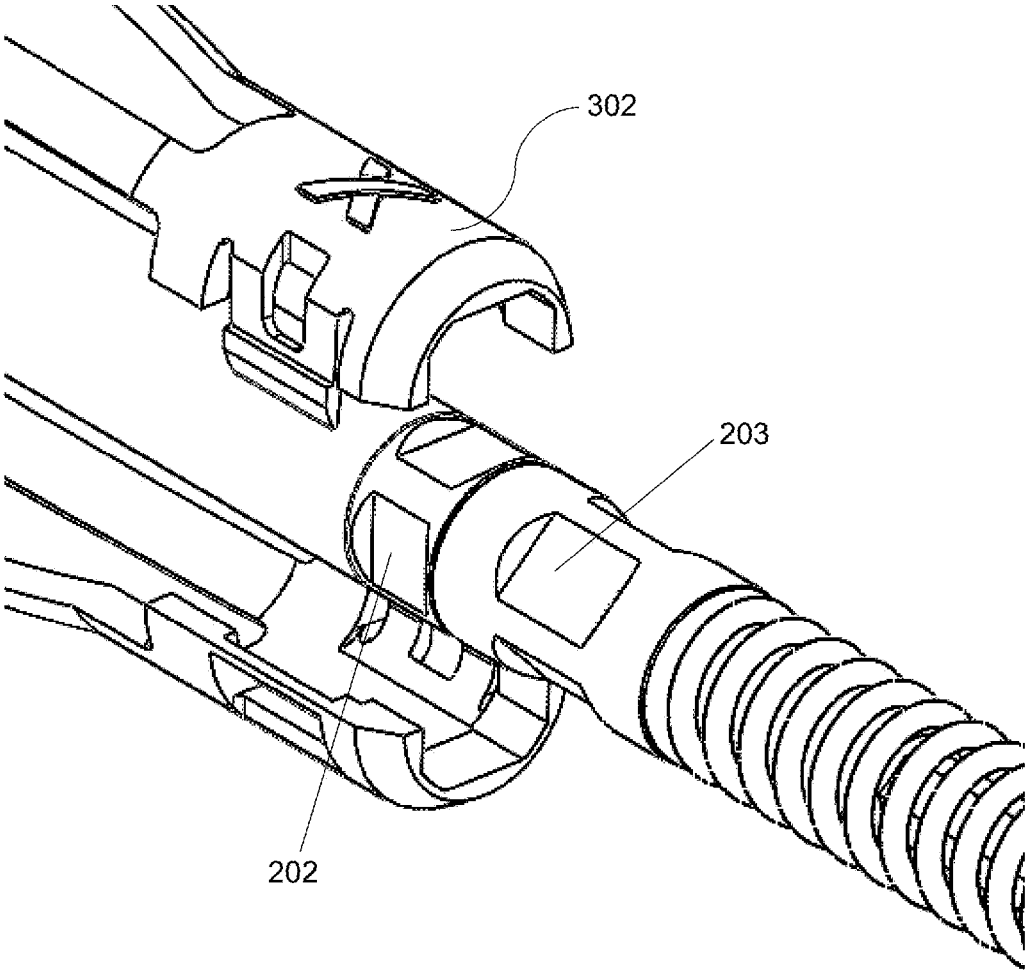
FIG. 4 shows a locator according to the first embodiment coupling to the survey apparatus.

FIG. 3B, 3D, 3E shows the assembly/installation process of the locator 300 according to this embodiment. It is desirable to install the locator 300 so it can take advantage of a tool engagement regions 125 of the survey apparatus 10. This is so that the receiver keys 311, 312 can engage with corresponding tool engagement regions 125 to provide longitudinal and/or rotational constraint of the locator 300 on the survey apparatus 10.

Each opposing member 301 is arranged either side of a suitable portion of the survey apparatus 10 where the locator 300 is to be installed. In this case, the receiver key 311 of the first apparatus coupling 302 of each opposing member 301 is aligned so it can seat on the first tool engagement portion 203, and the tab receiver key 312 of the first apparatus coupling 302 of each opposing member 301 is aligned to seat on the second tool engagement portion 202. The two opposing first apparatus couplings 302 are clipped together and secured around the tool engagement regions 202, 203/125. The second apparatus couplings 303 at the other end of the locator 300 are also clipped together around the survey apparatus 10, although in this case they form an internal cylindrical surface which just abuts against a cylindrical surface of the survey apparatus, without engagement or longitudinal/rotational restraint.

Multiple locators might be attached to various locations along the survey apparatus, as required. Preferably, at least 2 locators are used to provide stability, but in end-uses with more deviated environments, three to four or more locators would be appropriate.

The survey apparatus 10 can then be inserted into the borehole 15. The bearing portion 315 of the bearing members 304 will engage "x" with the side of the borehole 15, and squeeze members inwards to displacement "d" as the locator 300 is inserted into the bore hole. When the survey apparatus is in place, the reaction force of the compliant members will push against the borehole 15 to position the survey apparatus 10 in the correct radial position R and stabilise it in place.

During use, the bearing members 304 can move overcome any hole variance or debris in the hole without compromising the positioning of the tool in the hole 15. The different contact points bearing members are also designed to have different contact points "x" along the length of the tool so that circumferential features do not engage all of the members at one time preventing large shocks being received by the tool and additionally reduce the chance of the survey apparatus becoming stuck in hole.

When the survey is complete, the survey apparatus is retracted, and the locators can be removed by pressing on the tabs and disengaging the two opposing member halves.

Second Locator Embodiment

A second embodiment as shown in FIG. 5.

In this embodiment 500 there is only one coupling for each opposing member 501. The coupling is integrally formed in a body 501 of the opposing member. The coupling is generally cylindrical with a generally cylindrical gap, such that when coupling to the opposing member the assembly is cylindrical with a cylindrical gap through the centre.

The retention members are the same as for the first embodiment. The retention tabs provide a tab receiver key the same as described for the first embodiment that engage with a tool engagement region.

The bearing member 510 is formed as one or more cantilever leaf springs that apply an outward force from the outer surface of the body of the locator. The leaf spring has a bearing region.

The inner end of the coupling is not profiled to engage with tool engagement regions, although this is not essential and there could be a tool engagement region profile.

Third Locator Embodiment

A third embodiment of the locator 700 is shown in FIGS. 7 to 10.

In this embodiment the locator 700 has opposing locator members 701, but there is only one coupling 702 for each opposing member of the locator, formed as part of the opposing member. The coupling is generally cylindrical with a generally cylindrical gap, such that when coupling to the opposing member 701 the assembly 700 is cylindrical with a cylindrical gap through the centre. The bearing members 704 are formed as one or more radial flanges that apply an outward force from the outer surface of the body 701 of the locator 700. Once assembled, the locator takes the form of a cylindrical collar with radially extending bearing members.

The locator 700 will now be described in more detail. The locator comprises two (opposing) locator members 701 that are configured to cooperatively couple (e.g. clip) together around the survey apparatus 10' (see FIG. 10). (The locator members are identical, so the same reference numerals are used). Each locator member 701 is one half of the locator 700. Together the pair of locator members are opposing members 701 that assemble/couple around the survey apparatus 10' to form the resultant locator 700 on the survey apparatus. The locator has a longitudinal channel (best seen in FIG. 8) for receiving a survey apparatus 10'. Each opposing member 701 clips together around the survey apparatus 10' so that the survey apparatus sits in the resulting longitudinal channel. The opposing members 701 are also configured to decouple (e.g. unclip) to disassemble/decouple the locator from the survey apparatus 10'.

To do this, each opposing locator member 701 is formed as an apparatus coupling 702, which cooperate to make an apparatus coupling assembly in the form of an (annular) collar (see FIG. 8), configured to couple to the survey apparatus. More particularly, the apparatus coupling 702 (see FIG. 7) takes a generally semi-cylindrical form (half collar) which defines a space, such that when apparatus coupling 702 couples to the corresponding coupling 702 on the opposing member 701, the two apparatus couplings 702 cooperate to form a generally cylindrical assembly (collar) with a central opening (see FIG. 8). The coupling is integrally formed with the opposing member, such that they could be considered a single item, although for functional reasons can be considered and described separately.

The apparatus coupling of an opposing member has retention coupling 706 (see FIGS. 7, 8 and 10) for connecting to a corresponding retention coupling 706 of the apparatus coupling of the other opposing member. The retention coupling 706 takes the form of a snap fit cantilever male connector 706A and reciprocal female socket connector 706B. The male connector 706A of the first opposing member 701 engages with a reciprocal female socket connector 706B on the other opposing member 701, and the female socket 706B on the first opposing member 701 receives the reciprocal snap fit cantilever male connector 706A of the other opposing member. The snap fit cantilever tab 706A on each opposing member 701 has a tapered barb 709 for engagement in and retention by an abutment 710 on the female socket 706B on the opposing member (See FIG. 7).

Figure 8:
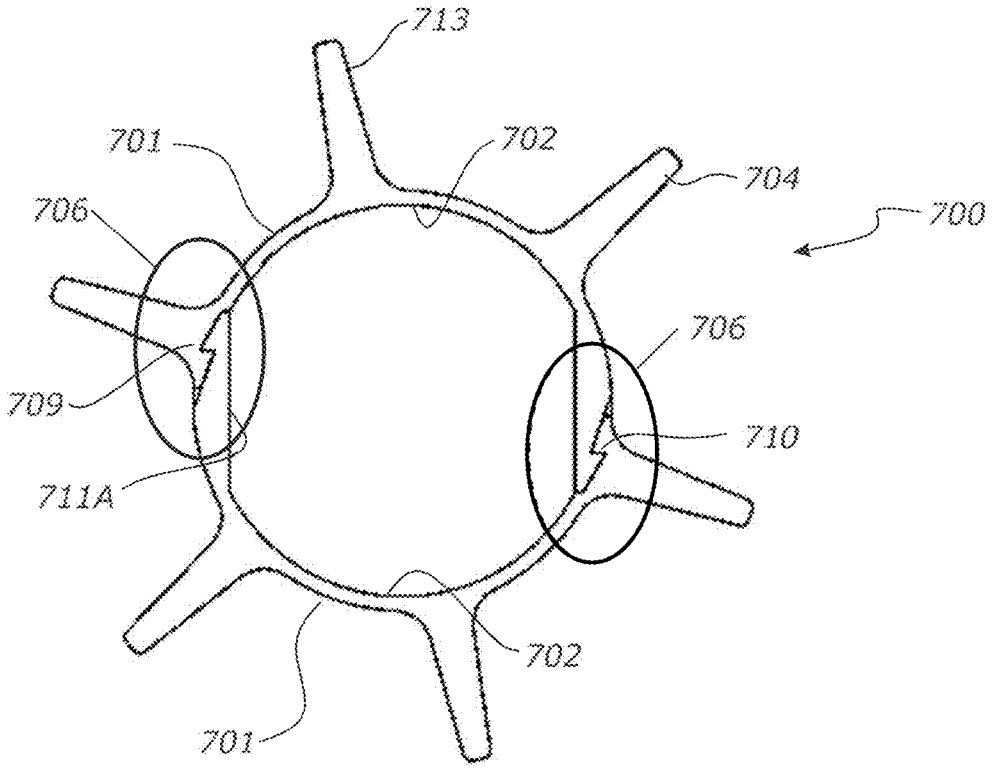

FIG. 8 shows the two opposing members 701 coupled together using the connectors 706A, 706B, where it can be seen that the male cantilevered tabs for each coupling are engaged in the corresponding female socket. This occurs easily in a snap fit movement that can be achieved by hand without tools. To uncouple the two opposing members, the user can press on the bevelled portion of the barb and unclip the barb from the socket.

Figure 9:
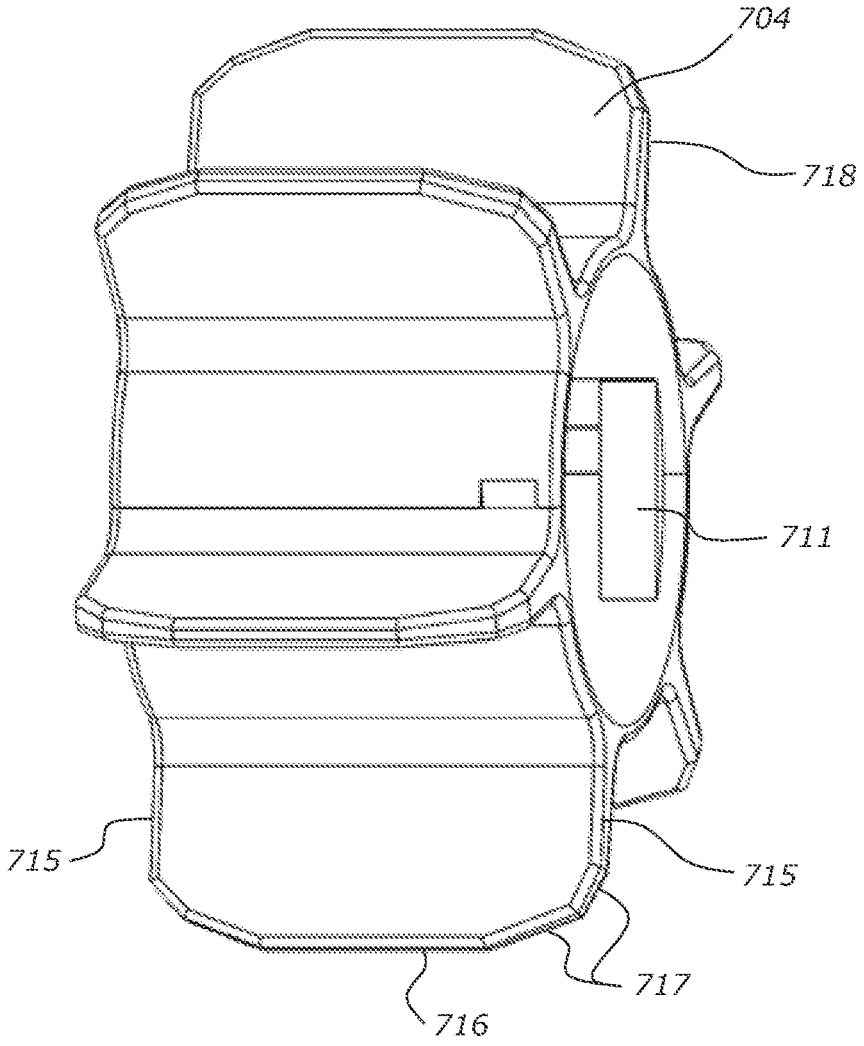
Figure 10:
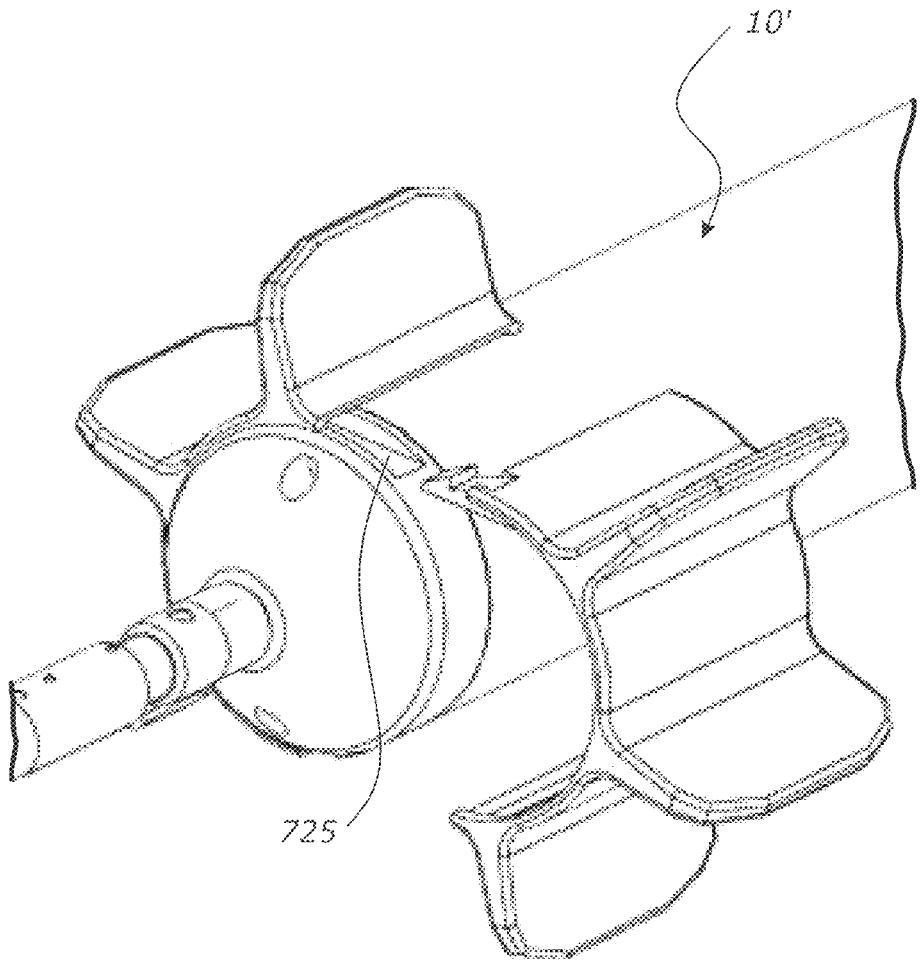

Referring to FIGS. 8, 9 and 10, the apparatus couplings 702 on each opposing member 701 in addition to connecting to each other, are configured to cooperatively couple to the survey apparatus 10' in a manner that constrains rotational and/or longitudinal movement of the couplings 702/members 701 and therefore the locator 700 with respect to the survey tool. Together the couplings 702 form the coupling assembly. To achieve this the cantilever tab 706A has a flat back surface 712 that is exposed to the inner gap of the apparatus couplings 702 of both opposing members 701. This forms a receiver key 711A having a complementary shape with part of the tool engagement portion 725 of the survey apparatus. Therefore, the retention coupling 706 (that is the male 706A/female connectors 706B) of the coupling assembly provides a profiled end (see FIG. 8 or 9) of the apparatus coupling that is configured to key (engage) with part of a tool engagement region (profiled region) 725 on the survey apparatus 10'. The profiled end forms a receiver key being complementary in shape with a tool engagement portion of the survey apparatus 10'. This can be seen better in FIG. 10. (In this case, the survey tool and tool engagement portion thereof is a different embodiment to that of FIG. 2, although this is by way of example and this embodiment could be configured with any suitable embodiment of a survey tool).

When the apparatus coupling 702 is disposed on the survey apparatus 10', the back 712 of the tab 706A seats/engages with the commensurate one side part of the tool engagement region 725 having the same shape. This flat tab 712 can engage with the tool engagement portion 725 to assist with longitudinal and/or rotational constraint. When the apparatus coupling 702 of one opposing member 701 joins with a complementary apparatus coupling of the other opposing member 701, the tab receiver key of both first apparatus couplings jointly form a side receiver key that seats/engages with the tool engagement region 725.

When the locator member 701/apparatus coupling 702 is disposed on the survey apparatus 10', the receiver key seats/engages with the commensurate shaped top/side part of the shape of the tool engagement region 725. The remainder of the inside of the apparatus coupling 702 can be any suitable shape such as semi-cylindrical to abut against the cylindrical shape of the housing of the survey apparatus 10'. Referring to FIGS. 8-10, when the apparatus coupling joins with the complementary apparatus coupling of the other opposing member, the receiver key of both first apparatus couplings jointly form a receiver key 711A with flat sides (see FIGS. 8, 9) that matches and seats/engages with the tool engagement region 125. Likewise the semi-cylindrical portions (see FIG. 7, 10) jointly form to create a cylindrical passage for receiving the survey apparatus 10.

It will be appreciated that this is just one type of retention coupling. Other types are possible. For example, there might be just a single male or female connector on each opposing member rather than both a male and female connector. Alternatively, a different type of snap fit, or even a different type of connector altogether could be used.

Each opposing member 701 has one or more bearing members 704 for bearing against a borehole wall to position a survey apparatus 10' radially within the borehole. The bearing members 704 take the form of flanges that radially extend from the opposing member 701 (which is in the form of a semi-cylindrical body).

The flange can be formed of a hard wearing and/or solid material.

Each flange takes the form of a thin plate arranged with the plate extending longitudinally on the locator member 701, providing a thin side profile 713 (see FIG. 8) in the longitudinal direction. The side profile might taper from base (the locator 701 collar) to the radial end. The thin profile 713 enables the flange to "slice" through any material (intrusions within the borehole), such as viscous muds/clays and/or other debris that may have collapsed into the borehole, as the survey tool 10'/locator assembly 700 travels down hole. Therefore, the flange can act as a blade. This enables the locator to move through mud and/or boreholes that vary in size. To help with slicing, the profiled edge 713 may have a chamfer 718 between it and the flat plate front.

Best seen in FIG. 9, the face of the plate is profiled in a generally oblong shape, having a perimeter with side edges 715 that extends radially outwards and a top edge/apex 716 that extends longitudinally between the radial side walls 715. The apex/top edge bears against the borehole wall to, in use with a survey apparatus, position the survey apparatus radially within the bore hole. The side perimeter might also chamfer/taper 717 between the side edges 715 and the top edge 716, and in this embodiment optionally has a two stage chamfer. This assists with the flange slicing through material, (a hard corner edge while possible, has a risk that it might get caught).

FIG. 10 shows the assembly/installation process of the locator according to this embodiment. It is desirable to install the locator 700 so it can take advantage of a tool engagement regions 725 of the survey apparatus 10'. This is so that the receiver keys 711 (see FIG. 9) can engage with corresponding tool engagement regions 725 to provide longitudinal and/or rotational constraint of the locator 700 on the survey apparatus 10'.

Other profiles of the flange are possible. For example, and without limitation, they could be circular, elliptical or otherwise shaped.

The flange radial dimension could vary in each case (that is, one or more flanges could have different radial lengths), to enable radial off set of the survey tool in the bore hole as previously explained for the first embodiment.

The flange plate might not necessarily extend the entire width of the locator collar.

The flange plates could be offset longitudinally to place the apex of each plate in a different longitudinal position to reduce the risk of the locator becoming stuck, as previously described with respect to the first embodiment.

Figure 11:
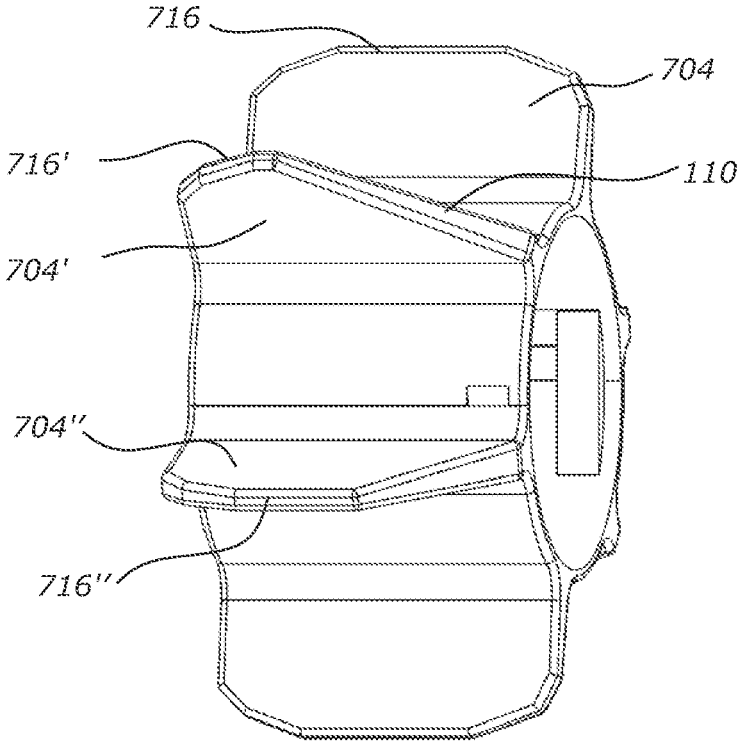
FIGS. 11, 12 show variations of the third embodiment.

For example, as shown in FIG. 11, a variation of the embodiment might have one or more of the flanges formed as a tapered wing 704', 704" or similar. One of the perimeter edges 110 facing the direction of downhole travel is tapered. This assists with slicing through material. Also, the length of one or more edge apexes could be different, to offset the bearing point—see e.g. flange 704' that has a shorter apex 716', and flange 704" that has a longer apex 716" (and original apex 716 is longer still). For 704' and 704", this results in different lengthened/angled tapers 110.

Figure 12:
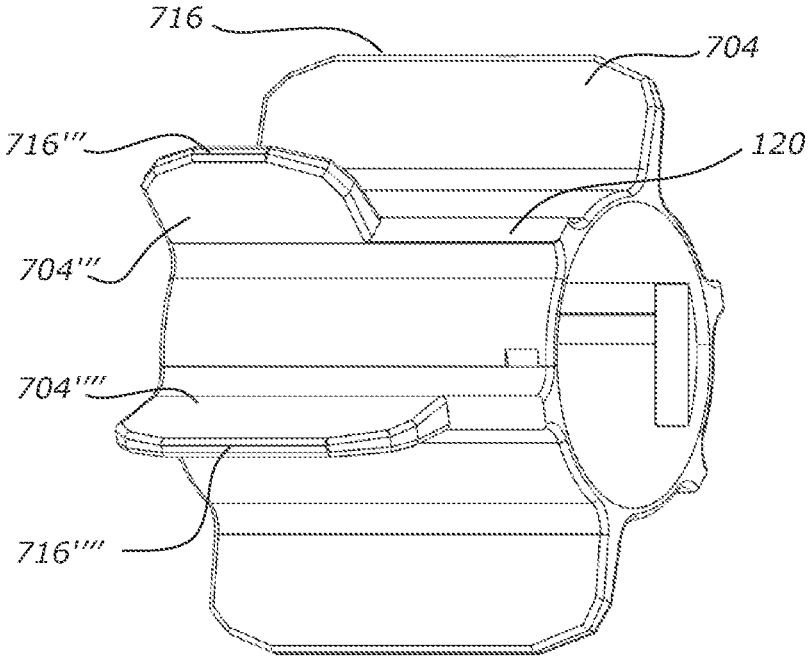

Also for example, as shown in FIG. 12, a variation of the embodiment might have one or more of the flanges formed with a cut-out 704''', 704"" or similar. Also, the length of one or more edge apexes could be different, to offset the bearing point—see e.g. flange 704''' that has a shorter apex 716''', and flange 704"" that has a longer apex 716"" (and original apex 716 is longer still). For 704''', 704"" this results in different sized cut-outs 120.

Each opposing member will be dimensioned (including each bearing member and the apex, will be provided in a longitudinal, rotational (around the apparatus) and radial position) to provide the required positioning of the survey apparatus 10 when in the borehole 15.

Each opposing member can be fabricated from any suitable material, such as plastics, metal, resin or similar. It is possible that the apparatus coupling may be fabricated from a different material to the bearing members, or the same material. The bearing members will be fabricated from a suitably compliant/resilient material. The parts of each opposing members could be moulded, machined or otherwise fabricated as a single integral component, or they could be assembled.

In the embodiments of FIGS. 7 to 12, the uphole end/edges of the locator opposing members 701 are uncoupled—both to each other and/or to the survey tool. In variations, a further (second) coupling might be provided to couple each locator opposing member 701 together at the uphole end and/or fix each locator opposing member 701 at the uphole end to the survey tool in a rotationally and/or longitudinally constrained manner. To achieve this, the opposing locator members 701 could be configured with a coupling as per any previous coupling described.

The flange e.g. 704, 704' etc. can be formed of a hard wearing and/or solid material. But alternatively it could be a soft and/or compliant material so the flange may have some "give"/compliance. This enables the flanges to conform to different contours of the bore hole and/or be at different heights (that is, different radial distances). In this case omitting a uphole end coupling, or having a floating uphole end coupling (such as per the first bow spring embodiment) might be required to provide for compliance. Alternatively, the flanges can be positioned at different places. For example, some could be set back from the collar. This then allows for the extensions to be at the same height or at a variety of heights. This means that not all the flanges contact the borehole wall at the same time. By being at different heights, this allows the tool to more readily negotiate its way past the intrusion(s) (muds/debris in the borehole) as one blade cuts through or moves through the intrusion at any one time.

In summary, these different design decisions combine to provide an appropriate amount of holding force to the borehole wall. Some materials are better suited for continuous flexure, e.g. plastics, silicon. A main design criteria is that the resultant sized locator is appropriately sized for the borehole.

In use, each opposing member 701 (of any of the variations) is arranged either side of a suitable portion of the survey apparatus 10' where the locator 700 is to be installed. In this case, the receiver key 711 (see FIG. 9) of the apparatus coupling of each opposing member 701 is aligned so it can seat on the tool engagement portion 725.

The two opposing apparatus couplings 702 are clipped together and secured around the tool engagement regions 725.

Multiple locators 700 might be attached to various locations along the survey apparatus 10', as required. For example, at least two locations are used to provide stability, but in end-uses with more deviated environments, three to four or more locations would be appropriate.

The survey apparatus 10' can then be inserted into the borehole 15. The bearing portion of the bearing members 704 will engage with the side of the borehole 15 as the locator 700 is inserted into the bore hole. When the survey apparatus is in place, the members will push against the borehole 15 to position the survey apparatus 10' in the correct radial position R and stabilise it in place.

During use, the bearing members e.g. 704, 704', 704" etc. can move/overcome any hole variance or debris in the hole without compromising the positioning of the tool in the hole 15. Depending on the configuration of the radial height and/or longitudinal position of the flanges, bearing members might have different contact points at the bore hole along the length of the tool so that circumferential features do not engage all of the members at one time preventing large shocks being received by the tool and additionally reduce the chance of the survey apparatus becoming stuck in hole.

When the survey is complete, the survey apparatus is retracted, and the locators can be removed by pressing on the tabs and disengaging the two opposing member halves.

Variations

Other variations of any of the embodiments could be conceived by those skilled in the art.

The bearing members in the embodiments shown are bow springs, flanges, leaf springs or similar, but this is not limiting. Any suitable bearing member could be used.

The embodiments described have two opposing members that are identical, but this is not essential. Variations in each opposing member could be used where advantageous.

The locator could be disposable—where it will be made of a plastic that will break down.

Colour or physical markings may be used to identify each part.

Bearing members may have physical markings (e.g. on the bow springs or short cantilever) to allow for a visual indicator to the user that the member has worn beyond the point of being used as intended. They can be replaced by the user without the need for a tool.

Any suitable mechanical or other latch could be used to join the two opposing members that can be connected and disconnected without the help of additional tools and without additional pieces of hardware (screws, snap rings, etc).

Locating features may be accompanied by other visual indicators to allow users a better visual means of correctly using the centralizer.

Advantages

A tool is not required to assemble and disassemble the locator allowing for ease of use, increased uptake use of the locator by an end user, and increased overall efficiency as there are improvements in the resultant survey results.

The bearing members can be configured for the required level of compliance, positioning and stabilisation.

The locators stay in place longitudinally and rotationally because they engage with a profiled region on the survey apparatus. Thus when the user starts the survey run, the user can be certain the locator is retained in that same position on the survey apparatus during the survey of the borehole.

The locator is not required to be tightened onto the housing.

Where appropriate, the locator leverages the existing profiled region (e.g. tool engagement region) of the survey apparatus for ease of installation.

Having a two-piece opposing member configuration allows a user to bring them together around the tool housing that generally has a circular diameter so when connected encircles the outside diameter of the tool.

No need for special tools.

The locator can optionally be made disposable, can be constructed from environmentally friendly materials and is lightweight.

The third embodiment in its variations also utilises the profiled regions on the survey tool to give the rotational and/or longitudinal constraint. In addition, the embodiments of FIGS. 7 to 12 can be useful in situations with mud, debris and other intrusions etc. (which might occur in wet conditions, for example) where the flanges can slice through the intrusion.

The invention claimed is:

1. A locator for positioning and/or stabilising a survey apparatus in a borehole comprising:

two opposing members for cooperatively coupling together around a survey apparatus, the survey apparatus comprising at least one profiled region for a locator on the survey apparatus, each opposing member comprising:

at least a first apparatus coupling, the first apparatus coupling configured to connect to a respective first apparatus coupling of the corresponding opposing member around the survey apparatus, one or more bearing members for bearing against a borehole, and wherein:

an internal profile of the at least first apparatus coupling is configured to engage with the at least one profiled region on the survey apparatus to, when one opposing member is cooperatively coupled with the corresponding opposing member around the survey apparatus, constrain a resultant locator on the survey apparatus longitudinally and rotationally; and wherein the at least first coupling of at least one of the opposing members is configured with a cantilever tab to cooperatively couple to the corresponding opposing member around the survey apparatus, wherein the cantilever tab has a back surface configured to engage with the at least one profiled region.

2. The locator according to claim 1 wherein each opposing member comprises a second apparatus coupling, wherein the bearing members are bow springs that extend between the first and second apparatus couplings.

3. The locator according to claim 1 comprising a second apparatus coupling on each opposing member, configured to:

connect to a respective second apparatus coupling of the corresponding opposing member and to slide longitudinally on the survey apparatus when the one opposing member is cooperatively coupled with the corresponding opposing member around the survey apparatus.

4. The locator according to claim 1 wherein:

each opposing member is integrally formed with the at least first apparatus coupling in the form of a half collar, and when the one opposing member is cooperatively coupled with the corresponding opposing member a collar is formed around the survey apparatus.

5. The locator according to claim 1, wherein the one or more bearing members are plates extending longitudinally on the opposing members that extend radially from the opposing members.

6. The locator according to claim 1, wherein the first apparatus coupling is at a first end of the locator and wherein the second end of the locator is configured to be floating with respect to the survey apparatus when installed.

7. The locator according to claim 1, wherein the bearing members have bearing portions to bear against the borehole.

8. The locator according to claim 7 wherein the bearing portions are offset longitudinally.

9. A locator member for cooperatively coupling together with an opposing locator member around a survey apparatus, the survey apparatus comprising at least one profiled region, the locator member comprising:

at least a first apparatus coupling, the first apparatus coupling configured to connect to a respective first apparatus coupling of an opposing locator member, one or more bearing members for bearing against a borehole, and wherein:

an internal profile of the at least first coupling is configured to engage with the at least one profiled region on the survey apparatus to, when the opposing locator member is cooperatively coupled with the opposing locator member around the survey apparatus, constrain a resultant locator on the survey apparatus longitudinally and rotationally; and wherein the at least first coupling of at least one of the opposing members is configured with a cantilever tab to cooperatively couple to the corresponding opposing member around the survey apparatus, wherein the cantilever tab has a back surface configured to engage with the at least one profiled region.

10. The locator member according to claim 9 comprising a second apparatus coupling, wherein the bearing members are bow springs that extend between the first and second apparatus couplings.

11. The locator member according to claim 9 comprising a second apparatus coupling on each opposing member, configured to:

connect to a respective second apparatus coupling of the corresponding opposing locator member and to slide longitudinally on the survey apparatus when the one opposing member is cooperatively coupled with the corresponding opposing member around the survey apparatus.

12. The locator member according to claim 9 wherein:

the opposing member is integrally formed with the at least first apparatus coupling in the form of a half collar, and configured to cooperatively couple with a corresponding opposing member so that a collar is formed around the survey apparatus.

13. The locator member according to claim 9, wherein the one or more bearing members are plates extending longitudinally on the opposing members that extend radially from the opposing members.

14. The locator member according to claim 9, wherein the first apparatus coupling is at a first end of the locator member and wherein the second end of the locator member is configured to be floating with respect to the survey tool when installed.

15. The locator member according to claim 9, wherein the bearing members have bearing portions to bear against the borehole.

16. A locator for positioning and/or stabilising a survey apparatus in a borehole comprising:

two opposing members each with an apparatus coupling for cooperatively coupling together around a survey apparatus, the survey apparatus comprising at least one profiled region for a locator on the survey apparatus, each opposing member comprising:

one or more bearing members for bearing against a borehole, and wherein:

the apparatus coupling is configured to connect to an apparatus coupling of the corresponding opposing member around the survey apparatus, and an internal profile of the at least first apparatus coupling is configured to engage with the at least one profiled region to, when one opposing member is cooperatively coupled with the corresponding opposing member around the survey apparatus, constrain a resultant locator on the survey apparatus longitudinally and rotationally, wherein the apparatus coupling has a cantilever tab that is configured to, when one opposing member is cooperatively coupled with the corresponding opposing member:

couple to a corresponding connector on the corresponding opposing member around the survey apparatus, and engage, through a back surface of the cantilever tab, with the profiled region on the survey apparatus to constrain the resultant locator on the survey apparatus longitudinally and rotationally.

17. The locator according to claim 1, wherein the at least one profiled region on the survey apparatus is a tool engagement region.

* * * * *